US006328589B1

(12) United States Patent
Annecke

(10) Patent No.: US 6,328,589 B1
(45) **Date of Patent: *Dec. 11, 2001**

(54) ELECTRICAL CONNECTOR

(75) Inventor: Alfred Annecke, Flein (DE)

(73) Assignee: Amphenol-Tuchel Electronics GmbH (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/391,201

(22) Filed: Sep. 7, 1999

(30) Foreign Application Priority Data

Sep. 7, 1998 (DE) ..... 198 40 726

(51) Int. Cl.[7] ..... H01R 13/627
(52) U.S. Cl. ..... 439/352; 439/489
(58) Field of Search ..... 439/350–352, 439/488, 489, 188

(56) References Cited

U.S. PATENT DOCUMENTS

| | | | | |
|---|---|---|---|---|
| 5,275,575 | * | 1/1994 | Cahaly | 439/352 |
| 5,647,757 | * | 7/1997 | Chrysostomou | 439/352 |
| 5,746,618 | * | 5/1998 | Gauker | 439/352 |
| 5,772,460 | | 6/1998 | Baumann | 439/352 |
| 5,816,840 | * | 10/1998 | Dullin | 439/188 |
| 5,853,298 | * | 12/1998 | Pacher | 439/352 |

FOREIGN PATENT DOCUMENTS

| | | | | |
|---|---|---|---|---|
| 195 13 358 | | 8/1996 | (DE) | H01R/13/639 |
| 195 00 959 | | 11/1996 | (DE) | H01R/13/639 |
| 195 34 205 | | 9/1997 | (DE) | H01R/13/629 |
| 196 17 820 | | 11/1997 | (DE) | H01R/13/639 |
| 19804599 | * | 8/1999 | (DE) | 439/188 |
| 0 591 947 | | 4/1994 | (EP) | H01R/13/639 |
| 0 591 948 | | 4/1994 | (EP) | H01R/13/639 |
| 0 734 101 | | 9/1996 | (EP) | H01R/13/627 |
| 0791987 | * | 8/1997 | (EP) | 439/188 |
| 2319673 | * | 5/1998 | (GB) | 439/188 |

* cited by examiner

*Primary Examiner*—Hien Vu
(74) *Attorney, Agent, or Firm*—Blank Rome Comisky & McCauley, LLP

(57) ABSTRACT

The invention concerns an electrical connector, in particular for use between a receptacle (squib) and an electrical control for a restrain system in motor vehicles.

8 Claims, 1 Drawing Sheet

ELECTRICAL CONNECTOR

BACKGROUND OF THE INVENTION

1. Technical Field of The Invention

The invention concerns an electrical connector, in particular for use between a receptacle (squib) and an electrical control for a restraint system in motor vehicles.

2. Description of Related Art

Such a connector is known from EP 0 591 947 A2, EP 0 591 948 A2, DE 195 00 959 C2 and DE 195 13 358 C1.

A connector according to the generic type has a very limited size (for example 2 to 3 cm long, about 1 cm wide and 0.1 to 1.0 cm high). Thus, the individual components of the connector or the associated receptacle are extremely small. Nevertheless, easy mounting and high reliability are required for applications concerning safety regulations (for example belt tensioner, air bag).

This is particularly true with respect to the engagement of the connector and the receptacle, where it is required that the contact springs of one of the components reliably contact the contact pins of the other component in the assembled condition, while not allowing the connector and the receptacle to become detached accidentally.

This problem is resolve in the prior art in that the connector and the receptacle are contacted and brought into engagement with each other in a first step and a locking member is brought behind catching arms of the connector as a so-called secondary locking in a second step, in order to prevent accidental detachment.

In principle, this constructive solution has proved its worth, but it requires two steps in assembly.

SUMMARY OF THE INVENTION

It is an object of the invention to develop a connector of the type mentioned above in which mounting is made easier without disadvantages with respect to the reliability of contact and the safety of engagement.

In order to solve this problem, the invention starts from the following premise. Contrary to the prior art, the locking member is formed in such manner that it can be arranged in the housing before engagement of the connector and receptacle. The locking member is mounted in such a manner that the catching arms are "blocked" to prevent engagement of the connector and the receptacle in that position.

In order to facilitate the engagement of the connector and the receptacle, the invention further provides for the locking member to be fed temporarily deeper into the housing to such a position in which the catching arms may be moved for engagement with the receptacle.

For that purpose, a goal of the invention is to adapt the locking member and the housing in such a manner that the locking member is situated in an initial (mounted) position which is in a "raised" position against the action of a spring, and such that it may be pushed deeper into the housing against the action of the spring for engagement of the connector and receptacle, and, therefore, moves back (springs back) automatically, because of the spring action, to the initial position after the connector and the receptacle have come into engagement.

In this way it is assured that the catching arms of the housing are secured against accidental detachment from the catching means of the receptacle when the connector and the receptacle are engaged.

The invention comprises an electrical connector, in particular for use between a receptacle (squib) and an electrical control for a restraint system in motor vehicles, having the following features:

- a housing for receiving electrical cables and having contact springs connected thereto,
- the contact springs serving to receive contact pins of the associated receptacle, and
- resilient catching arms on the housing for securing the housing to the receptacle, and
- a locking member having a number of locking arms corresponding to the number of catching arms, The invention in its most general embodiment is characterized in that

- the housing has a spring acting on a base part of the locking member, which pushes the locking member from a maximum insertion position in which the catching arms are free to move into a locking position with corresponding catching means on the receptacle to a position in which the locking arms secure the catching arms against accidental detachment.

The fundamental advantage of the connector described above is that the locking member may be mounted in a factory and that this step can be eliminated in mounting, for example in a motor vehicle.

For mounting the mechanic proceeds as follows:

- He takes the connector, puts it on the receptacle and pushes a base part of the locking member, for example. The locking arms are pushed deeper into the housing thereby, that is to a position in which they do not hinder a backward movement of the catching arms of the housing.
- In that condition the connector is pushed into the receptacle until the contact pins of the receptacle are placed in the contact springs of the connector and the catching arms are engaged behind the corresponding catching means of the receptacle.
- Then the mechanic relieves the pressure on the base part of the locking member (by taking off his hand from the connector), which springs back automatically because of the spring described above and moves the locking arms to a position in which they are positioned behind the catching arms of the housing to lock them in the sense of a secondary locking. Now, the receptacle and the connector are connected functionally and are secured against detaching.

All the steps mentioned above can be carried out with one hand and in one operation.

For detaching the connector and the receptacle the mechanic pushes against the base part, for example, and thereby pushes the locking arms against the action of the spring to the maximum insertion position so that the catching arms are "free" and the connector may be detached from the receptacle.

The constructive design described above may be realized both in a bent embodiment, as described in DE 195 00 959 C2, and in an "axial" embodiment, as disclosed by DE 195 13 350 C1, in which the locking member is displaceable in the direction of insertion.

In order to enable a locking function with respect to the catching arms (in the locking position) on the one hand and movement of the catching arms during the process of insertion (insertion position) on the other hand, an embodiment of the invention provides locking arms with a rod-like portion and a widened region at the free end and catching arms having a recess on their surfaces facing the locking arms, respectively, which enables the reception of the associated rod-like portion in the maximum insertion position of the locking member. An alternative embodiment provides the end of the locking arms towards the respective catching arm with an enlargement (thicker).

Here the locking arms may be "T-shaped" —as illustrated in the embodiments.

In the locking position ("raised" position of the locking member) the widened (or enlarged) portion of the locking arms is situated behind the catching arms and prevents movement thereof. On the other hand, in the insertion position each widened or enlarged portion of each locking arm projects downwards beyond the associated catching arm. The catching arms spring "towards the inside" in connecting them to the associated receptacle, because the catching arms have longitudinally grooves on the back, which reach beyond the tapered rod-like portions of the locking arms or because the catching arms and the locking arms are spaced apart.

Another embodiment of the connector arranges the locking arms of the locking member in parallel and spaced apart, with at least one transversal web extending beside the locking arms, which has at least one catching projection or a recess on its outer face, which catches at least one recess or at least one catching projection (detent) of the housing in the locking position of the locking member.

An accidental detachment of the locking member is prevented reliably in this manner.

In analogy to the embodiment according to DE 195 00 959 C2 the connector may have a three-part housing having a housing bottom for receiving the contact springs, a housing top for covering the housing bottom and securing the electrical cables between the housing bottom and top, as well as said locking member which can be inserted into the housing top through a corresponding opening, arranged in the housing top.

The housing top and/or the locking member may be connected to the housing (bottom) via resilient tongues.

The linkage of the locking member via resilient tongues supports the movement of the locking member from the maximum insertion position to the (raised) locking position.

Guiding and mounting the locking member is facilitated, if the housing has a collar around its portion for receiving a base part of the locking member, projecting beyond the base part in the inserted condition of the locking member.

The design of the spring on the housing may be chosen so that the spring is unstressed when the locking member is not inserted as well as when in the locking condition. Thereby, the spring is actuated only when the locking member is pushed into the insertion position. That single stress on the spring increases the reliability of the spring which typically will only be stressed a second time after years, when the connector is to be detached from the receptacle.

Further advantages of the connectors are:

The catching arms are locked in the condition of delivery of the connector. In that way an accidental placement of the connector on a receptacle is prevented.

When the connector is brought into engagement with the receptacle, a complete engagement is always assured. Because of the action of the spring in situ the locking member is brought automatically to the position of the secondary locking after the mounting process. In this respect it is impossible for the mechanic to forget to bring the locking member in its functional position.

Mounting is simplified and shortened, because the insertion and locking are effected in a single operation.

Further characteristics of the invention follow from the detailed disclosure which follows.

BRIEF DESCRIPTION OF THE FIGURES OF DRAWING

The invention is explained in more detail below with an embodiment shown in the following figures of drawing wherein.

Figure 2A:
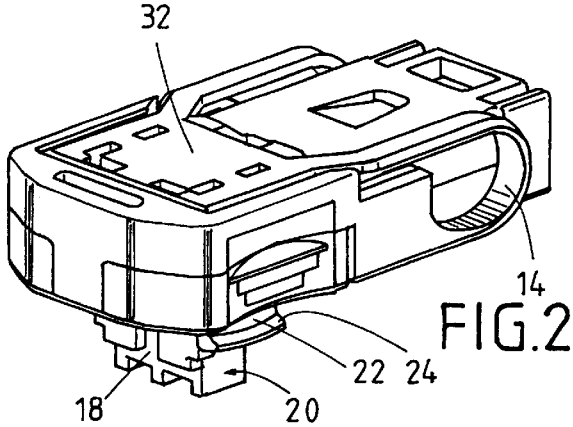
FIG. 2A is a perspective view of the connector according to FIG. 1 in the condition of delivery.
Figure 2B:
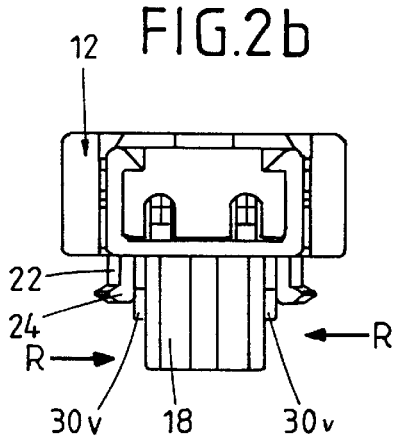
FIG. 2B is a sectional view of the connector depicted in FIG. 2A.
Figure 3A:
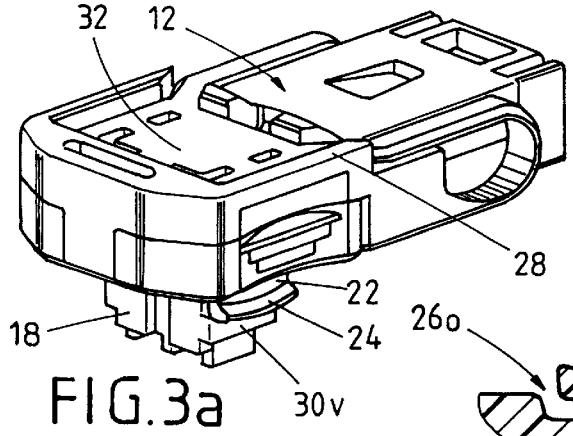
FIG. 3A is a perspective view of the connector in a position in which it is brought into engagement with an associated receptacle.
Figure 3B:
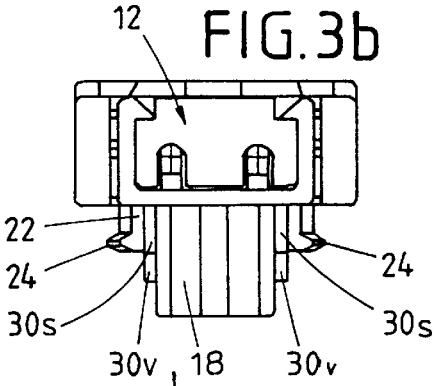
FIG. 3B is a sectional view of the connector depicted in FIG. 3A.
Figure 4:
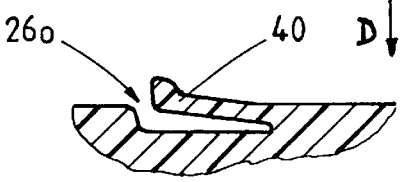
FIG. 4 is a schematic view of spring 40 taken on a plane of symmetry of the connector of the invention.

Sectional views are related to each of the FIGS. 2 and 3, which show the respective position of the catching arms on the housings with respect to the corresponding arms of the locking member.

DETAILED DESCRIPTION OF THE PREFERRED EMBODIMENT

Figure 1:
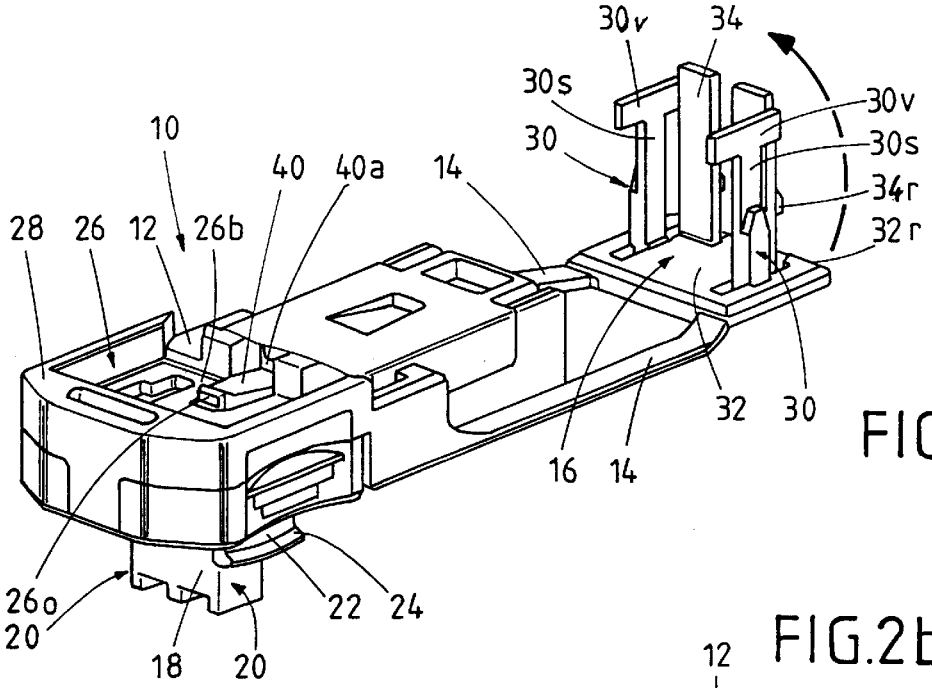
FIG. 1 is a perspective view of a connector with a locking member, not inserted.

A connector being indicated as a whole with reference number 10 in FIG. 1 consists substantially of a housing 12 and a locking member 16 connected thereto via tongues 14.

The housing 12 has a snout-like projection 18 in a downward direction, in which contact springs are situated for receiving contact pins of an associated receptacle.

Catching arms 22 extend adjacent to lateral surfaces 20 of the snout 18, which project downwards from the upper housing body and have arched detents 24 on the outside.

A recess 26 can be seen on the top of the housing 12, which is limited on three sides by a collar 28 of the housing.

Four slot-like openings are disposed in the bottom 26*b* of the recess 26, which serve to receive the corresponding parts of the locking member 16.

The locking member 16 comprises two lateral locking arms 30 projecting perpendicularly from a base part 32.

Each locking arm 30 comprises a rod-like portion 30*s* and a widened region 30*v* at the end so that a shape more or less like a T results for each locking arm 30 in the view according to FIG. 1.

Two further arms 34 extend adjacent to the outer edge 32*r* of the base part 32, beside the locking arms 30, each of which has a detent 34*r* on its outside.

The connector according to FIG. 1 is fabricated in the factory in a manner as shown in FIG. 2. In this manner, locking arms 30 and the arms 34 of the locking member 16, respectively, are inserted into the corresponding slots in the region of the recess 26, the end position (mounting position) being reached when the detents 34*r* of the arms 34 catch corresponding openings of the housing.

In that position the base part 32 of the locking member 16 is situated on a spring 40 formed in the region of the recess 26, in such a manner that the spring 40 is unstressed.

As is shown in FIG. 1, spring 40 extends freely from a region 40*a* of connection on the housing into recess 26. Under spring 40, bottom 26*b* of recess 26 is formed having an opening 26*o*.

In the mounting position widened region 30*v* at the ends of the locking arms 30 are situated immediately behind the catching arms 22 of the housing and prevent catching arms 22 from being moved in the direction of arrow R.

For connecting the connector to an associated receptacle (not illustrated), a mechanic takes connector 10 and pushes the top of base part 32 which is moved thereby in the direction of arrow D (FIG. 3) against the force of spring 40. At the same time locking arms 30 are inserted deeper into housing 12, to a position as shown in the sectional view of FIG. 3B. In that maximum insertion position of locking member 16 widened portions 30*v* of locking arms 30 are situated under detents 24 and catching arms 22. Accordingly, when placed upon the receptacle catching arms 22 spring behind corresponding catching means of the receptacle because catching arms 22 have corresponding recesses on the back (adjacent to the locking arms 30), which reach beyond the rod-like portions 30*s* of the locking arms 30, respectively.

When the receptacle is being inserted on the connector catching arms 22 move in the direction of arrow R to engage corresponding catching means of the receptacle. Once engaged they move back under spring action to their unstressed position (catching position).

If the mechanic relieves the pressure on base part 32 after the catching arms 22 have engaged the catching means on the receptacle spring 40 acts on base part 32 and pushes locking member 16 upwards by a distance so that the widened portions 30*v* of the locking arms are again situated behind the catching arms 22, as shown in the sectional view of FIG. 2B.

The locking condition in which the spring 40 is again unstressed corresponds to the condition according to FIGS. 2A and 2B.

What is claimed is:

1. An electrical connector for connecting a receptacle including a catching means and an electrical control for a restraint system in motor vehicles, said electrical connector comprising:

a housing for receiving electrical cables, said housing having a recess with openings in the recess for receiving locking arms, contact springs connected therein for receiving contact pins of an associated receptacle and a spring extending upwardly and into said recess for acting against a base of a locking member;

resilient catching arms on the housing to engage the corresponding catching means of the receptacle for securing the housing to the receptacle; and a locking member having a base and a plurality of locking arms extending from the base for insertion in said openings in the recess of the housing corresponding to the catching arms on the housing;

wherein when said base of the locking member is inserted in said recess of the housing, said spring acts on the base of the locking member to bias the locking member to a locking position in which the locking arms secure the catching arms against accidental detachment from the catching means on the receptacle, and when the base of the locking member is depressed by an operator, the locking member moves against the bias of the spring to a maximum insertion position in the housing in which the catching arms are free to move to engage the corresponding catching means on the receptacle and when the operator releases the pressure on a top wall of said base, the locking member moves from the maximum insertion position to the locking position by the action of the spring and wherein the locking arms each include a rod-like portion and a widened portion extending transversely from said rod-like portion at a free end thereof and the catching arms each include a recess on a surface thereof which faces the locking arms for receiving the rod-like portion of the locking arms when the locking arms are in the maximum position.

2. The connector according to claim 1, wherein the locking arms of the locking member are disposed parallel and spaced apart from each other and the locking member further comprises at least one transverse member which extends from the base of the locking member, said transverse member having at least one projection on an outer surface thereof which engages at least one corresponding recess in the housing when the locking member is inserted into the locking position in the housing.

3. The connector according to claim 1, wherein the housing includes a housing bottom, a housing top for covering the housing bottom and securing the electrical cables between the housing bottom and top and the locking member which can be moved through corresponding openings in the housing top.

4. The connector according to claim 1, wherein the locking member is connected to the housing via resilient tongues.

5. The connector according to claim 1, wherein the housing has a collar within which the base of the locking member is received such that the collar projects beyond the base when the locking member is inserted into the housing.

6. The connector according to claim 1, wherein the spring is in an unstressed condition when the locking member is not inserted in the housing.

7. The connector according to claim 1, wherein the spring is in an unstressed condition when the locking member is in the locking position in the housing.

8. The connector according to claim 1, wherein the spring is in a stressed condition when the locking member is in the maximum insertion position in the housing.

* * * * *